United States Patent [19]

Bengtsson et al.

[11] Patent Number: 4,679,632

[45] Date of Patent: Jul. 14, 1987

[54] REMOTELY CONTROLLED RISER CONNECTION

[75] Inventors: Lars Bengtsson, Torslanda; Johan Sjölander, Gothenburg, both of Sweden

[73] Assignee: Gotaverken Arendal AB, Sweden

[21] Appl. No.: 854,539

[22] Filed: Apr. 22, 1986

[30] Foreign Application Priority Data

May 15, 1985 [SE] Sweden ..... 8502419

[51] Int. Cl.[4] ..... E21B 43/01

[52] U.S. Cl. ..... 166/345; 166/359; 166/367; 114/264

[58] Field of Search ..... 166/345, 359, 367; 114/264, 260; 285/24, 25, 26, 27, 28, 29

[56] References Cited

U.S. PATENT DOCUMENTS

| | | | |
|---|---|---|---|
| 3,355,899 | 12/1967 | Koonce et al. | 114/265 |
| 3,389,671 | 6/1968 | Yost | 114/265 |
| 3,426,858 | 2/1969 | Bauer et al. | 166/359 |
| 3,966,235 | 6/1976 | Lewis | 285/28 |
| 4,194,568 | 3/1980 | Buresi | 166/367 |
| 4,273,068 | 6/1981 | McNary | 114/264 |
| 4,294,564 | 10/1981 | Person et al. | 114/264 |
| 4,401,164 | 8/1983 | Baugh | 166/367 |
| 4,448,568 | 5/1984 | Gentry et al. | 166/345 |
| 4,550,936 | 11/1985 | Haeber et al. | 285/26 |
| 4,557,332 | 12/1985 | Denison et al. | 166/345 |

*Primary Examiner*—Stephen J. Novosad
*Assistant Examiner*—William P. Neuder
*Attorney, Agent, or Firm*—Wegner & Bretschneider

[57] ABSTRACT

A watertight compartment at a floating production plant handing crude oil and/or gas has at least one remotely releasable two-part connecting piece for a riser conduit between the sea floor and the plant. The compartment includes a sealing collar mounted in the bottom plating of the plant. The collar provides a sealing with respect to an upper half of the connection piece in relation to the compartment, as well as with a lower half of the connection piece, which is surrounded by water.

4 Claims, 4 Drawing Figures

10
11
12
13
14
15
16
16a
17
17a
18
19a
19b
20
21
22
23
24
25
27
30
31
31b
32
33
34
35
35a
II
III

REMOTELY CONTROLLED RISER CONNECTION

BACKGROUND OF THE INVENTION

The present invention refers to a watertight compartment in a floating plant for processing crude oil and/or gas having at least one remotely releasable two-part connection piece for a riser between the sea floor and the plant.

For the processing of crude oil and/or gas from offshore wells a floating plant will be connected to one or more wells by a bundle of rigid pipes or flexible, reinforced hoses designed to withstand high pressures.

The pipes, or hoses, are usually connected to the plant by remotely releasable two-part connection pieces located outside the shell of the vessel carrying the plant, either above or below the water line. The releasability is necessary for rapidly moving the plant from the production site, for instance when dangerous icebergs appear. It will also be necessary to release the connection pieces if the anchoring devices or the automatic positioning system of the plant fails.

Connection pieces located above the water line will easily be damaged through collision with other vessels, or ice floes.

Connection pieces located below the water line can be located so they run considerably less risk of being damaged, for instance when mounted in the bottom plating of the vessel carrying the plant. With conventional vessels for this purpose the bottom plating will be located 15–20 meters below the water line. It will however then be necessary to use divers, or some diving equipment for inspection and overhaul of the connection pieces, which implies certain risks and is expensive.

One possible solution to simplify the work of inspection and overhaul of the rather complicated mechanism of a remotely releasable riser pipe connection piece is to locate the latter in a compartment, open downwards to the surrounding water, which is connected to a compressor for holding an air pressure within the compartment corresponding to the external water pressure. In such a manner the level of the water within the compartment can be maintained about at the downwardly directed opening.

This solution does, however, involve certain problems, in that the bulkheads surrounding the compartment must be dimensioned to withstand a rather high pressure, and that operating staff can remain within the compartment during a limited time only, without being subjected to time consuming decompression afterwards.

SUMMARY OF THE INVENTION

The object of the present invention is to propose a connection device at a riser conduit, which makes possible inspection and overhaul in a simple manner.

The invention is characterized in that the compartment is provided with a sealing collar connected to the bottom plating of the plant and sealingly carrying an upper half of the connection piece accessible from the compartment, and providing reception space open to the surrounding water for the lower half of the connection piece.

According to a favourable development the compartment is provided with a travelling crane movable along beams above a row of riser conduits for retracting lower connection piece halves into associated sealing collars by means of a lifting wire passing through locks at the upper connection piece halves.

An upper connection piece half is preferably connected to rigid product transfer pipes by way of flexible joint portions, permitting the lifting of the upper connection piece half from the collar for maintenance and overhaul.

Furthermore an upper connection piece half is advantageously provided with a removable cowl, which when the sealing collar is closed downwards by a cover permits access to the upper half of the connection piece.

DETAILED DESCRIPTION

Figures 1, 3, 4:
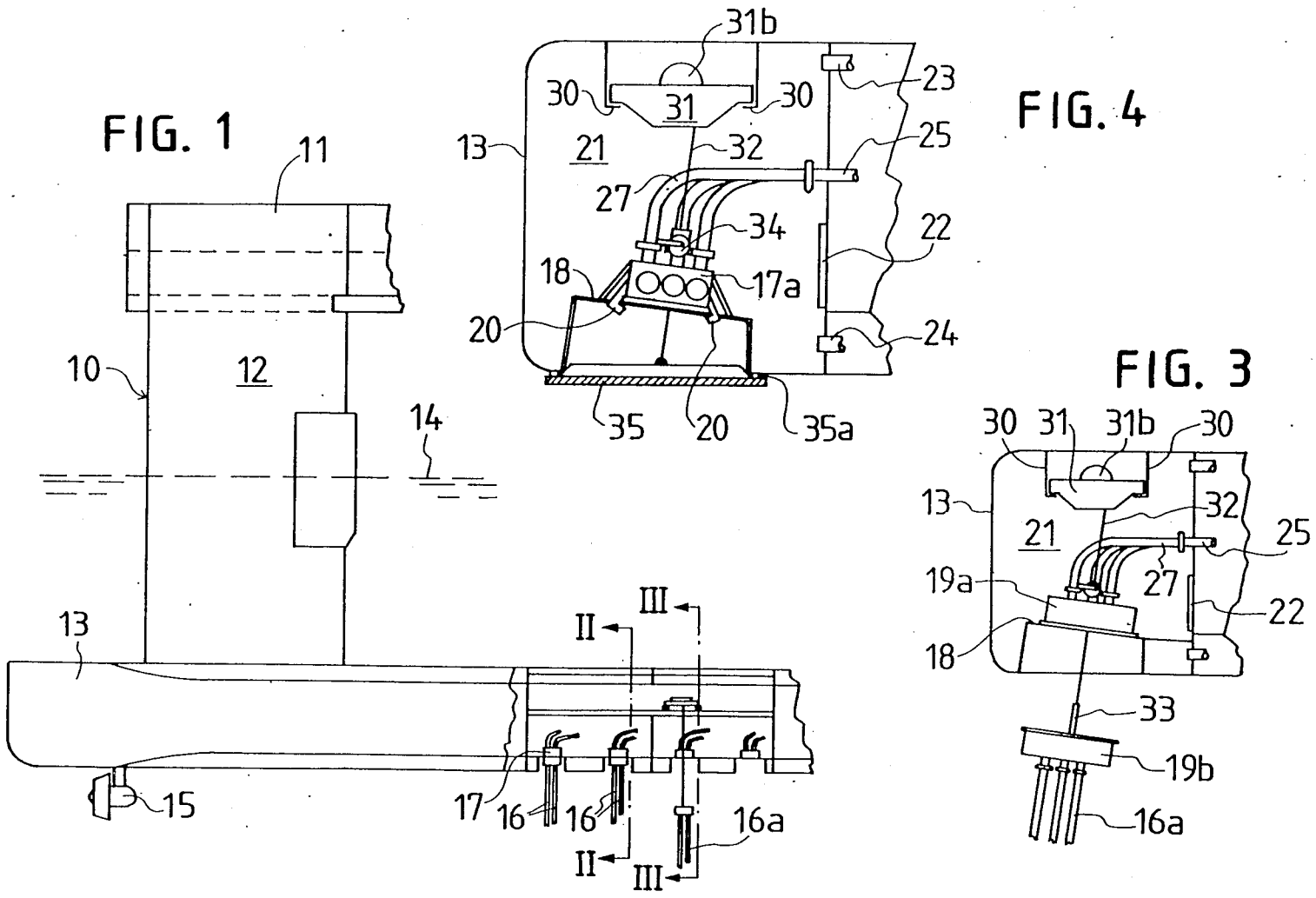
FIG. 1 shows an elevation of a portion of a semi-submersible production plant, partly cut-up, with a number of riser conduits connected according to the invention.
FIG. 4 shows, on a larger scale, a section through the compartment during an overhaul operation.

The production plant 10, partly shown in FIG. 1 is fitted in a vessel provided with an operating deck 11, which is carried by columns 12 resting upon pontoons 13. The columns 12 and the pontoons 13 are in a conventional manner provided with a ballast system for determining the draft of the vessel in relation to the water surface 14. The pontoons are provided with thruster propellers 15 for propelling and positioning of the vessel.

Riser conduits 16 extend from the sea floor, and are connected to the underside of a pontoon 13 by way of two-part connection pieces 17. FIG. 1 shows two riser conduits 16 connected to the vessel, and a further riser conduit **16*a*** being hauled in for connection.

Figure 2:
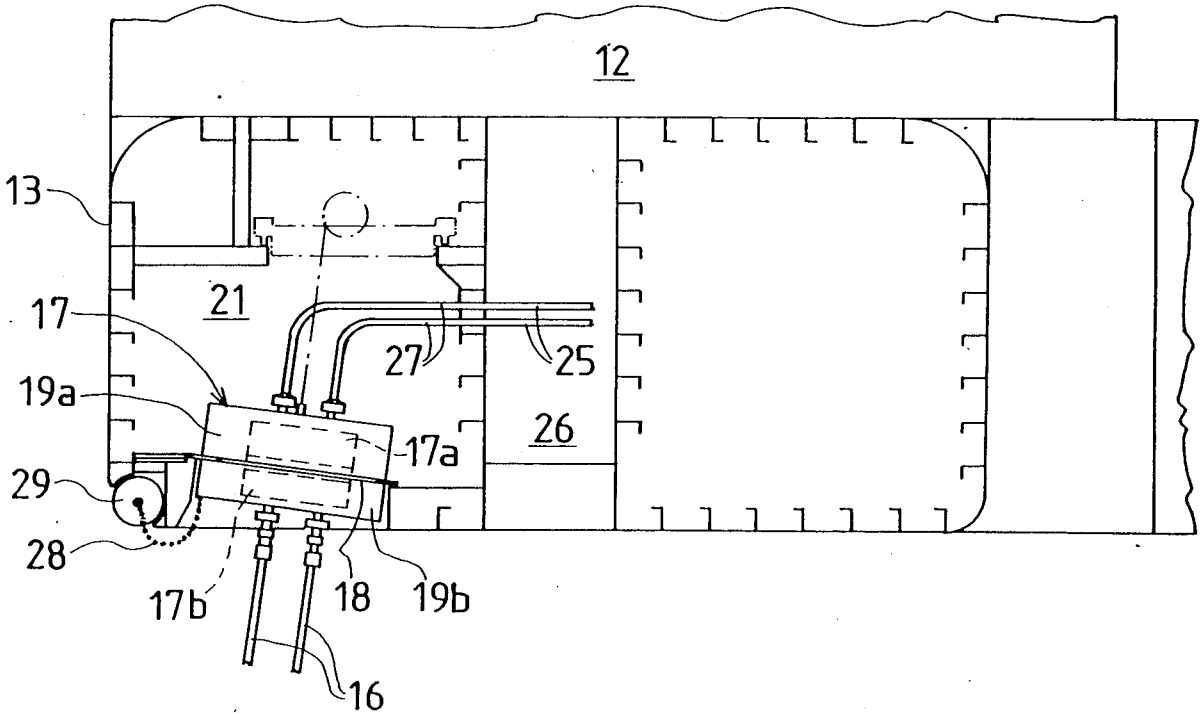
FIG. 2 is a section along line II—II in FIG. 1 on a somewhat larger scale, and with a travelling crane denoted by broken lines, FIG. 3 a section along line III—III in FIG. 1.

FIG. 2 shows, on a larger scale, one of the connection pieces 17, which includes an upper half **17*a* and a lower half 17*b*. These are watertightly mounted in a sealing collar 18, which forms an upwardly directed recess in the bottom plating of the pontoon 13 for accommodating the lower connection piece half. The sealing collar 18 is designed in such a manner, that the connection piece halves, individually or together, form a water lock together with the collar. Ordinarily the upper half 17*a* is bolted to the collar 18 by means of an upper cowl half 19*a*, while the lower half 17*b* is retained by means of remotely releasable locating devices 20 (see FIG. 4) together with a corresponding lower cowl half 19*b***.

All together there are four connection pieces 17 located in the same compartment 21 within the pontoon 13. This compartment is accessible by way of a watertight door 22, and is ventilated by means of conduits 23, 24 supplying and withdrawing air, and provided with shut-off valves. Rigid steel pipes 25 for the products extend through a tunnel 26 into the compartment 21. These pipes 25 are connected to the upper connection piece halves by way of flexible joint portions 27.

A lower connection piece half **17*b* is connected to a float 29 by way of a chain 28**. The float will provide a released riser end with some buoyancy, so it does not sink freely and rams into the sea floor.

FIG. 3 shows how the end of a riser is hauled upwards for connection by using a travelling crane 31 movable along beams 30 positioned above the row of connection pieces within the compartment 21. A winch 31*b* upon the travelling crane operates a wire 32, which is connectable to a guiding peg 33 at the lower connector half 17*b*. The wire 32 passes through a wire lock 34 at the upper connector half 17*a*. This permits the wire to run up or down without water entering the compartment 21.

FIG. 4 shows the compartment 21 during an overhaul operation at the upper connector half 17*a*. The downwardly directed opening in the recess formed by the collar 18 is closed by a cover 35, which by way of a rubber packing 35*a* abuts against the bottom plating of the pontoon, and is retained by means of the wire 32. The upper cowl half has been dismounted from the sealing collar, and the remotely releasable locking devices 20 are accessible, as well as valves and packings at the upper connector half.

Also the lower connector half 17*b* may be accessible while still mounted in the collar. The lower connector half will then be secured to the downward face of the collar 18 by means of separate retention means (not shown). Thereafter the connector devices 20 are released and the upper cowl half 19*a* is dismounted from the collar, whereupon the upper connector half may be removed therefrom by means of the wire 32 of the travelling crane. The flexible joint portions 27 permit such movement without disconnection from the upper connector half.

While the invention has been particularly shown and described in reference to preferred embodiments thereof it will be understood by those skilled in the art that changes in form and details may be made without departing from the spirit and scope of the invention.

The compartment 21 is provided with detector means for sensing the presence of water, oil and/or gas, which are well known in this art and are not shown, as well as means for pumping out water.

The lower connector part 19*b* is provided with non-return valves, which permits gas to be expelled into the surrounding water if a big leak should occur within the compartment 21. Simultaneously a release of the riser conduits 10 is initiated. By the supply of halon gas to the compartment 21 possible remaining gas will be rendered harmless.

The invention is not limited to the embodiment described above, but a number of modifications are possible, within the scope of the appended claims.

The compartment 21 may thus be provided with explosion protecting bulkheads.

We claim:

1. A vessel for processing crude oil and/or gas and including a watertight compartment adjacent to its bottom plating, said compartment communicating by way of at least one product transfer pipe with a processing plant or with storage means within the vessel and connectable to at least one riser conduit extending from a well at the sea floor, a recessed sealing collar within said bottom plating, a two part connection piece having a first part connected to said product transfer pipe and a second part connected to said riser conduit, means for watertightly mounting said first part in said collar, and remotely releasable means for holding said second part to said first part.

2. A vessel according to claim 1 in which said compartment encloses a number of collars arranged in a row and further having a travelling crane with winch and movable along beams above said row of collars, each of said first connection piece parts having a watertight lock for the passage of said winch wire.

3. A vessel according to claim 1 in which said product transfer pipe rigidly projects into said compartment and said first connection piece part is connected thereto by a flexible joint portion.

4. A vessel according to claim 1 in which said compartment is provided with winch means operating a wire and said first connection piece part has a watertight lock for said wire, and further including a lid for closing said collar downwardly, when said second connection piece part has been released, said lid having means for attaching said winch wire.

* * * * *